United States Patent [19]

Ruspa et al.

[11] 4,330,047

[45] May 18, 1982

[54] SOUND-ATTENUATING VENTILATION

[75] Inventors: Giacomo Ruspa; Luigi Franco, both of Turin, Italy

[73] Assignee: Centro Ricerche Fiat S.p.A., Turin, Italy

[21] Appl. No.: 182,532

[22] Filed: Aug. 29, 1980

[30] Foreign Application Priority Data

Oct. 5, 1979 [IT] Italy ..... 68932 A/79

[51] Int. Cl.[3] ..... E04F 17/04

[52] U.S. Cl. ..... 181/224; 98/DIG. 10

[58] Field of Search ..... 181/224; 98/88 L, 121 R, 98/121 A, DIG. 10, 43 R; 160/236

[56] References Cited

U.S. PATENT DOCUMENTS 2,299,112 10/1942 Schilling ..... 181/224
4,276,954 7/1981 Romano ..... 181/224

FOREIGN PATENT DOCUMENTS 1084891 7/1960 Fed. Rep. of Germany ..... 98/121
959959 10/1949 France ..... 181/224

*Primary Examiner*—L. T. Hix
*Assistant Examiner*—Thomas H. Tarcza
*Attorney, Agent, or Firm*—Sughrue, Mion, Zinn, Macpeak and Seas

[57] ABSTRACT

A sound-attenuating ventilation louver is provided for location in an aperture of a wall which separates a chamber containing a source of noise from the external environment, the purpose of the louver being to allow gaseous flows to pass into and out of the chamber while minimizing the noise passing out through the louver from the noise source. The louver includes a plurality of profiled slats each in the form of an aerodynamically-shaped blade. Each slat includes a solid portion made of a sound-absorbent material and a hollow portion defined by a thin wall of rigid material; in use of the louver the sound-absorbent solid portion of each slat is disposed towards the chamber containing the noise source while the hollow portion is disposed towards the external environment. The hollow portion of each slat is subdivided into a plurality of chambers communicating with the atmosphere through ports and acting as resonators.

12 Claims, 3 Drawing Figures

SOUND-ATTENUATING VENTILATION

The present invention relates to a sound-attenuating ventilation louver for location in an opening of a wall which separates a chamber containing a source of noise from the external environment, the louver being of the type comprising a plurality of profiled slats so arranged that in the operative orientation of the louver in said opening, each slat slopes upwardly across its width away from said external environment whereby a first one of the two major surfaces of the slat faces upwardly towards said environment while the second one of said two major surfaces faces downwardly towards said chamber. A louver of this type is intended to allow the exchange of gaseous flows between the said chamber and the external environment while at the same time serving to attenuate sound emissions from the noise source as they pass through the louver towards the external environment. Such louvers are also known as "acoustic grills".

Ventilation louvers are known which include a plurality of slats of a rectangular or an L- or S-shaped cross-section, the slats being made by pressing out sheet metal. When suitably orientated, the slats serve to deflect downwardly sound waves emitted by a noise source so that the propagation of the sound waves to the head height of a person positioned on the opposite side of the louver to the noise source is avoided; however, the sound waves are merely deviated by the slats without their intensity being reduced.

Ventilation louvers are also known which comprise slats so disposed as to partially occlude the wall opening in which the louver is located, the purpose of this arrangement being to allow sound waves to pass into the external environment only through a fraction of the area of the wall opening. Louvers of this form have in practice only been found to bring about a small reduction in the intensity of the sound radiation transmitted through the louver. Furthermore, the use of louvers of this form around noise sources (for example, internal combustion engines) which use the louver for drawing in air or for the exhaustion of the combustion products, causes a considerable "loading" of the noise source which is highly undesirable.

In addition, arrangements have been proposed in which a first ventilation louver, formed of sound-absorbent material, is used to attenuate the noise coming from the noise source, while a second louver, formed solely of metallic material and opening into the external environment, performs the task of protecting the noise source from external agents, for example, from atmospheric precipitation.

The object of the present invention is to provide a ventilation louver of the type specified above which simultaneously performs the following functions:

substantial reduction of the level of the noise passing into the external environment from the noise source;

protection of the noise source from external agents; and a reduction in the loading effect produced by the louver in cases where the louver is used as an intake or exhaust opening for a noise source such as an internal combustion engine.

In order to achieve this object, the present invention provides a sound-attenuating ventilation louver of the above-mentioned type wherein each said slat is in the form of an aerodynamically-shaped blade the two major surfaces of which are connected by curved end sections of convex profile, each said slat comprising:

a solid portion formed from sound-absorbent material and extending from an intermediate zone of the slat to the longitudinal edge thereof which in the operative orientation of the louver is nearest the chamber containing the noise source, and a hollow portion extending from said intermediate zone to the longitudinal edge of the slat which in the operative orientation of the louver is nearest the said external environment, said hollow portion being defined by a wall of rigid material and being sub-divided into a plurality of chambers each of which communicates with the atmosphere through at least one hole and acts as a resonator.

A ventilation louver of this form not only achieves a considerable reduction in the level of sound passing through the louvers from the noise source, but also protects the noise source from external agents and reduces the loading of the noise source by the louver in cases where the noise source is an internal combustion engine or similar machine which uses the louver as an intake or exhaust opening.

Preferably the chambers of the hollow portion of each slat constitute at least two groups of resonators, the resonators of each group being tuned to a common frequency which is different to that of the other group or groups.

A sound-attenuating ventilation louver embodying the invention will now be particularly described, by way of example, with reference to the accompanying diagrammatic drawings, in which.

Figure 1:
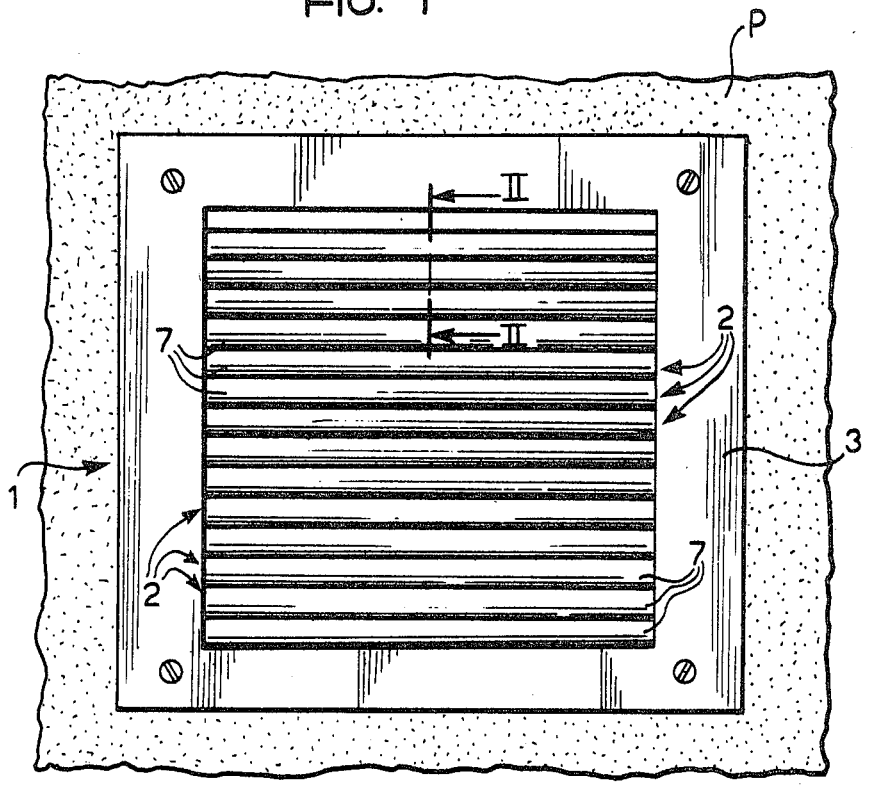
FIG. 1 is a front view of the ventilation louver.

As shown in FIG. 1, the ventilation louver comprises a plurality of profiled slats 2 connected at their opposite ends to a frame 3. The ventilation louver 1 is located in an aperture (not visible in FIG. 1) of a wall P which separates a chamber containing a noise source (not shown) from the external environment.

Figure 2:
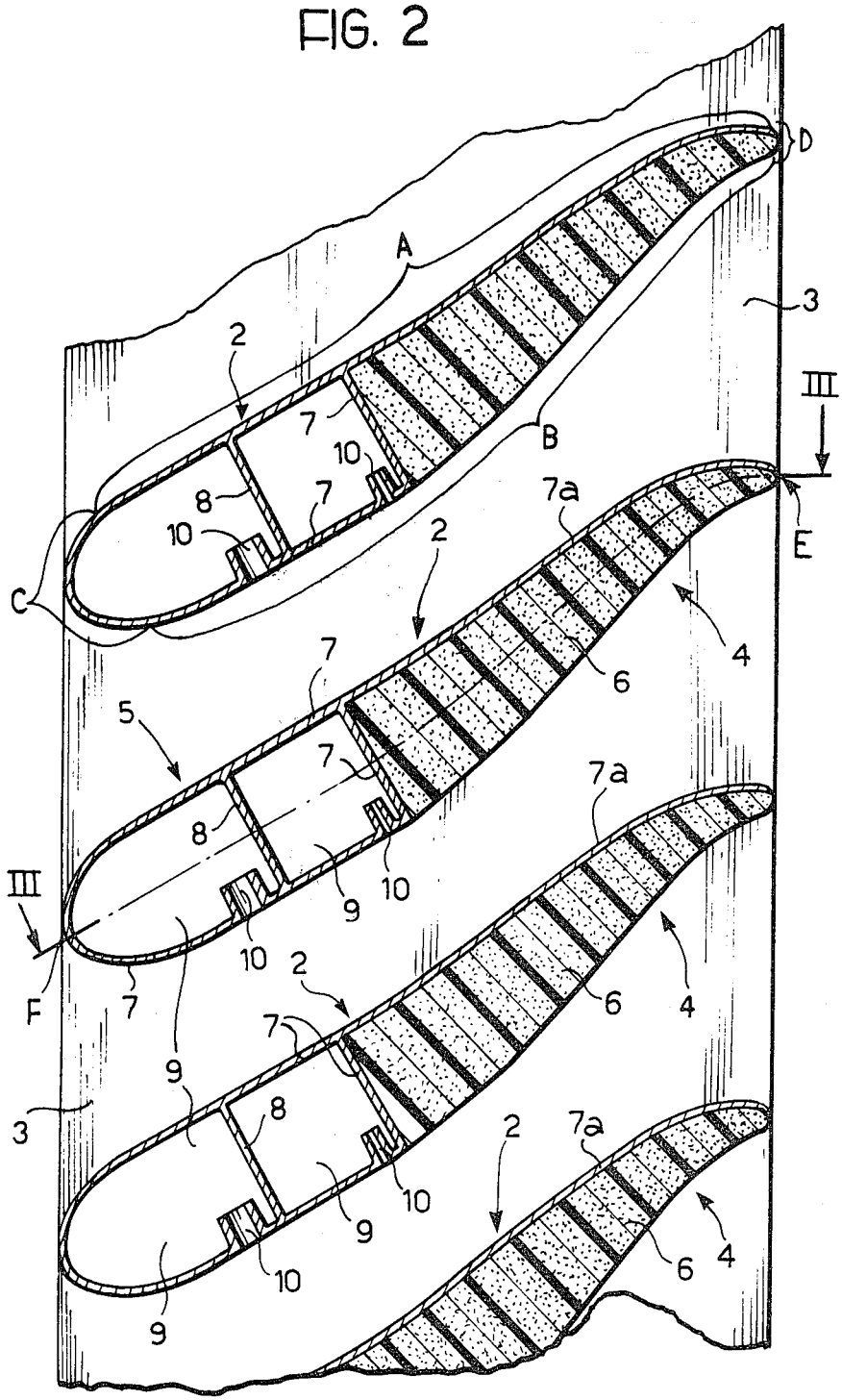
FIG. 2 is a section on line II—II of FIG. 1.

As can be seen in FIG. 2, each slat 2 is in the form of an aerodynamically-shaped blade with upper and lower major surfaces A and B which are interconnected by two curved end sections C, D of convex profiles.

In FIG. 2, the noise source (not shown) should be understood as being situated to the right of the ventilation louver while the external environment is situated to the left of the louver 1.

Each slat 2 includes a solid portion 4, and a hollow portion 5. The solid portion 4 comprises an element 6 of sound-absorbent material, for example, polyurethane, and extends from the longitudinal edge E of the slat 2 which is nearest the chamber containing the noise source, up to an intermediate zone of the slat 2.

The hollow portion 5 extends between the said intermediate zone and the longitudinal edge F of the slat 2 which is nearest the external environment.

The hollow portion 5 is defined by a thin wall 7 of rigid material and is sub-divided by partitions 8 into a plurality of chambers 9. Each chamber 9 communicates with the atmosphere through holes 10 and acts as a resonator.

Figure 3:
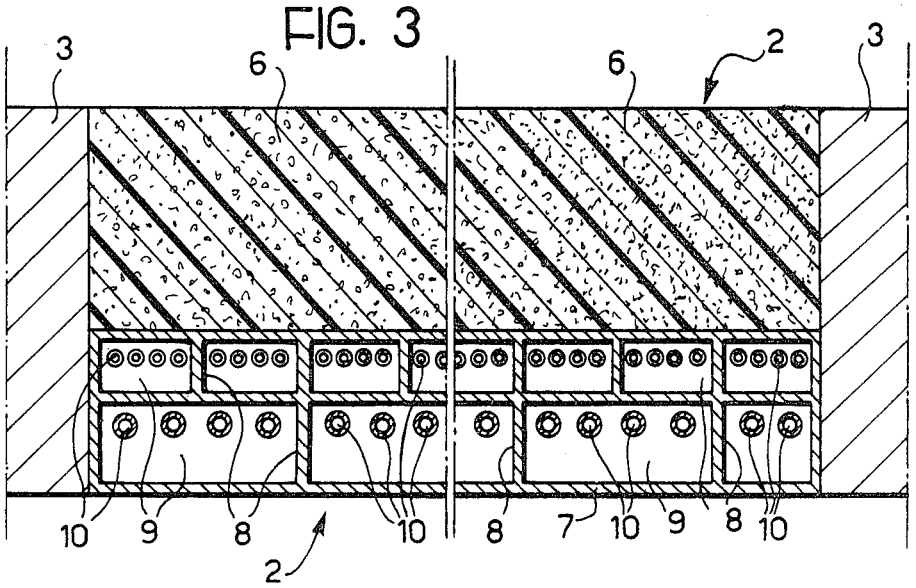
FIG. 3 is a section on line III—III of FIG. 2.

As shown in FIG. 3, the chambers 9 of the hollow portion 5 of each slat 2 form at least two groups of resonators, each group being tuned to a different frequency. As is illustrated, these groups of resonators may be disposed in two rows extending parallel to the longitudinal edges F,E of the slat 2.

With reference to FIG. 2, it can be seen that the hollow portion 5 of each slat 2 is of substantially uniform thickness, while the solid portion 4 has a thickness which decreases progressively from the intermediate zone of the slat 2 towards the longitudinal edge E nearest the chamber containing the noise source. Consequently, between each pair of adjacent slats 2 there is defined an air-flow duct which progressively increases in cross-sectional area from the external environment towards the chamber containing the noise source.

The solid portion 4 of each slat 2 is shaped substantially in the form of a beak, and has upper and lower surfaces which have a double curvature.

Conveniently the distance between the two adjacent slats 2 in the region of their hollow portions 5 (as measured between the respective lower and upper surfaces) is equal to about half the distance between their longitudinal edges E (that is, their edges nearest the chamber containing the noise source). Furthermore the upper and lower surfaces of the hollow portion 5 of each slat 2 are conveniently inclined at about 30° to the horizontal.

The part of the wall 7 which separates the solid and hollow portions 4 and 5 of each slat 2 extends parallel to the longitudinal edges E,F of the slat 2 and meets the lower surface B of the slat 2 along a line lying substantially in the horizontal plane which is tangential to the right-hand end of the upper surface A of the underlying slat 2 (as viewed in FIG. 2).

Preferably, for each slat 2 the element 6 of sound-absorbent material is strengthened by an extension 7*a* of the upper portion of the wall 7, this extension 7*a* being affixed to the upper surface of the said sound-absorbent element 6.

Conveniently, the distance between two adjacent slats 2 as measured between the lower and upper surfaces of their hollow portions 5 is equal to about 1/5 of the thickness of the ventilation louver 1.

The operation of the illustrated ventilation louver will now be described.

Most of the sound radiation which emanates from the noise source and is incident on the louver 1, will strike the sound-absorbent elements 6 of the slats 2 and be considerably reduced in intensity. The greatly-attenuated sound radiation reflected by the sound-absorbent elements 6 travels on between adjacent slats 2 towards the external environment and undergoes a further loss of energy due to the action of the resonator chambers 9. The action of the resonators is particularly marked at the frequencies to which they are tuned. Suitable dimensioning of these resonators 9 enables their resonance frequencies to be set to correspond substantially with the frequencies of the peaks of the noise-emission spectrum of the noise source.

In the embodiment illustrated in FIGS. 2 and 3 two groups of resonators are provided tuned to different respective frequencies; such an embodiment is particularly well suited to situations where the emission spectrum of the noise source has two peaks.

When the emission spectrum of the noise source has a different number of peaks, a corresponding number of groups of resonators can be provided, each group being dimensioned such that it is tuned to a respective one of the peaks of the emission spectrum.

As already mentioned, the air-flow ducts which are defined between adjacent slats 2, progressively increase in cross-sectional area from the external environment towards the chamber containing the noise source. Due to their form, these air-flow ducts allow kinetic energy to be recovered from the gases drawn through the louver and this enables a considerable reduction to be achieved in the "load" loss of a noise source constituted, for example, by an internal combustion engine for which the louver serves as the air intake opening.

Moreover, since the slats 2 are inclined to the horizontal, they serve to protect the noise source against the action of external atmospheric agents such as rain and snow.

Various modifications to the described louver are of course possible. Furthermore, it is to be understood that the solid portion 4 of each slat 2 can be made of any suitable sound-absorbing material including foamed solids.

Finally, it is noted that the criteria for the correct dimensioning of the resonator chambers 9 are well known in the art, and are clearly explained, for example, in the article "Influence of Air Flow on the Attenuation Characteristics of Resonator Type Mufflers" by Y. Hirata and T. Itow which appeared in Acustica, vo. 28 (1973) pages 115–120.

We claim:

1. A sound-attenuating ventilation louver for location in an opening of a wall which separates a chamber containing a noise source from the external environment, said louver comprising a frame and a plurality of horizontally disposed profiled slats supported by said frame and so arranged that in the operative orientation of the louver in said opening, each slat slopes upwardly across its width away from said external environment whereby a first one of the two major surfaces of said slat faces upwardly towards said environment while the second one of said two major surfaces faces downwardly towards said chamber, each said slat being in the form of an aerodynamically-shaped blade the two major surfaces of which are connected by curved end sections of convex profile, each said slat comprising:

a solid portion formed from sound-absorbent material and extending from an intermediate zone of the slat to the longitudinal edge thereof which in the operative orientation of the louver is nearest the said chamber containing the noise source, and a wall of rigid material defining a hollow portion extending from said intermediate zone to the longitudinal edge of said slat which in the operative orientation of the louver is nearest the said external environment, said hollow portion being subdivided into a plurality of chambers each of which acts as a resonator and is in communication with the atmosphere through at least one hole defined in said wall.

2. A louver according to claim 1, wherein for each said slat the part of the said wall which separates the said solid and hollow slat portions extends parallel to the longitudinal edges of the slat and meets the said second surface of the slat along a line lying substantially in the horizontal plane which is tangential to the said first surface of the neighbouring slat in the region of the end thereof provided by its solid portion.

3. A louver according to claim 1, wherein the said holes through which the chambers of each slat communicate with the atmosphere, are formed in the said second surface of the slat.

4. A louver according to claim 1, wherein the said chambers of each slat form at least two groups of resonators, the resonators of each group being tuned to a common frequency different to that of the other group or groups of resonators.

5. A louver according to claim 4, wherein two resonator groups are provided in each slat, the resonators of each group being disposed in a respective row extending parallel to the said longitudinal edges of the slat.

6. A louver according to claim 4, wherein for each said slat, the resonators making up a group of resonators tuned to the same frequency are disposed in a row extending parallel to the longitudinal edges of the slat.

7. A louver according to claim 1, wherein the hollow portion of each said slat is of substantially uniform thickness whereas the solid portion of the slat has a thickness which decreases progressively away from the said intermediate zone of the slat.

8. A louver according to claim 7, wherein the solid portion of each slat is profiled substantially in the form of a beak, with both said major surfaces of the slat exhibiting double curvature in the region of said beak.

9. A louver according to claim 1, wherein the sound-absorbent material constituting the solid portion of each slat is reinforced along the said first surface of the slat by an extension of the part of the said rigid-material wall which bounds the hollow portion along said first surface of the slat.

10. A louver according to claim 1, wherein the distance between two adjacent slats as measured between their facing first and second surfaces in the region of said hollow portions, is equal to about half the distance between their longitudinal edges which in use of the louver are nearest the said chamber containing the noise source.

11. A louver according to claim 1, wherein the slats are so arranged that, in the operative orientation of the louver, both said major surfaces of each slat are inclined at about 30° to the horizontal in the region of the hollow portion thereof.

12. A louver according to claim 1, wherein the distance between two adjacent blades in the region of their hollow portions is equal to about 1/5 of the overall thickness of the louver.

* * * * *